US008500572B2

(12) United States Patent
Curtis et al.

(10) Patent No.: US 8,500,572 B2
(45) **Date of Patent: *Aug. 6, 2013**

(54) GOLF CLUB HEAD WITH IMPROVED PERFORMANCE

(75) Inventors: Andrew J. Curtis, Carlsbad, CA (US); Charles E. Golden, Carlsbad, CA (US); Scott A. Rice, Carlsbad, CA (US); Douglas E. Roberts, Carlsbad, CA (US); Thomas W. Preece, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/600,291

(22) Filed: Aug. 31, 2012

(65) Prior Publication Data

US 2012/0322581 A1 Dec. 20, 2012

Related U.S. Application Data

(63) Continuation of application No. 12/643,203, filed on Dec. 21, 2009, now Pat. No. 8,262,501.

(51) Int. Cl.
*A63B 53/04* (2006.01)

(52) U.S. Cl.
USPC ..... 473/329; 473/330; 473/345

(58) Field of Classification Search
USPC ..... 473/324–350, 287–292
See application file for complete search history.

(56) References Cited

U.S. PATENT DOCUMENTS

| | | | |
|---|---|---|---|
| 5,366,223 | A | 11/1994 | Werner et al. |
| 5,944,620 | A | 8/1999 | Elmer |
| 5,954,596 | A | 9/1999 | Noble et al. |
| 6,007,432 | A | 12/1999 | Kosmatka |
| 6,152,833 | A | 11/2000 | Werner et al. |
| 6,319,150 | B1 | 11/2001 | Werner et al. |
| 6,354,962 | B1 | 3/2002 | Galloway et al. |
| 6,368,234 | B1 | 4/2002 | Galloway |
| 6,381,828 | B1 | 5/2002 | Boyce et al. |
| 6,390,933 | B1 | 5/2002 | Galloway et al. |
| 6,398,666 | B1 | 6/2002 | Evans et al. |
| 6,508,722 | B1 | 1/2003 | McCabe et al. |
| 6,595,869 | B2 | 7/2003 | McCabe et al. |
| 6,824,475 | B2 | 11/2004 | Burnett et al. |
| 6,997,821 | B2 | 2/2006 | Galloway et al. |
| 7,086,962 | B2 | 8/2006 | Galloway et al. |
| 7,147,575 | B2 | 12/2006 | Galloway et al. |
| 7,153,221 | B2 | 12/2006 | Hocknell et al. |
| 7,220,190 | B2 | 5/2007 | Hirano |
| 7,331,877 | B2 | 2/2008 | Yamaguchi et al. |
| 7,549,934 | B2 | 6/2009 | Rice |
| 7,591,737 | B2 | 9/2009 | Gibbs et al. |
| 7,682,263 | B2 | 3/2010 | Yamamoto |

(Continued)

*Primary Examiner* — Sebastiano Passaniti
(74) *Attorney, Agent, or Firm* — Randy K. Chang

(57) ABSTRACT

A golf club head with an improved sweet spot, defined as a portion of the striking face that has at least 99.7% of the maximum ballspeed is disclosed herein. More specifically, the present invention discloses a golf club head with a significantly circular sweet spot that encompasses at least about 1.5% of the total striking face. A golf club head in accordance with the present invention may generally have a improved face geometry with an elliptical factor of greater than about 0.5, a beveled transition portion around the striking face of the golf club head, a variable face thickness region with decreases thickness, or even a tilted bulge and roll radius all helping improve the performance of the golf club head.

16 Claims, 14 Drawing Sheets

U.S. PATENT DOCUMENTS

| | | | | |
|---|---|---|---|---|
| 7,704,162 | B2 | 4/2010 | Rice et al. | |
| 7,762,907 | B2 | 7/2010 | Rice | |
| 7,850,544 | B2 | 12/2010 | Meyer et al. | |
| 7,980,963 | B2 | 7/2011 | Rice et al. | |
| 8,038,544 | B2 | 10/2011 | Meyer et al. | |
| 8,152,652 | B2 * | 4/2012 | Curtis et al. | 473/330 |
| 8,197,356 | B2 * | 6/2012 | Curtis et al. | 473/329 |
| 8,251,834 | B2 * | 8/2012 | Curtis et al. | 473/329 |
| 8,262,501 | B2 * | 9/2012 | Curtis et al. | 473/329 |
| 8,303,432 | B2 * | 11/2012 | Curtis et al. | 473/329 |
| 2004/0116202 | A1 | 6/2004 | Lin | |
| 2005/0059508 | A1 | 3/2005 | Burnett et al. | |
| 2007/0275791 | A1 | 11/2007 | Shear | |
| 2010/0105501 | A1 | 4/2010 | Wada et al. | |
| 2010/0255930 | A1 | 10/2010 | Rice et al. | |

* cited by examiner

GOLF CLUB HEAD WITH IMPROVED PERFORMANCE

CROSS REFERENCE TO RELATED APPLICATION

The present application is a Continuation of U.S. patent application Ser. No. 12/643,203, filed Nov. 21, 2009, now U.S. Pat. No. 8,262,501, the disclosure of which is incorporated by reference in its entirety.

FIELD OF THE INVENTION

The present invention relates generally to a golf club head that is capable of achieving an improved sweet spot, defined as a portion of the striking face that has at least 99.7% of the maximum ballspeed. More specifically, the present invention relates to a golf club head wherein the sweet spot covers at least 1.5% of the entire total striking face of the golf club head. Even more specifically, the present invention relates to a golf club head with a significantly elliptical shaped striking face with an elliptical factor of greater than about 0.50 to achieve an improved sweet spot, wherein the elliptical factor is defined as the length of the minor axis divided by the length of the major axis. The present invention may also relate to a golf club head with a tilted bulge and roll radius to further improve the performance of the golf club head.

BACKGROUND OF THE INVENTION

In the competitive industry of golf club design, distance and accuracy are two of the most important performance factors that help define the desirability of a metal wood type golf club. Although some may argue that the look, feel, and sound of a golf club may influence their opinion of a golf club; there is no arguing that the performance factors play a major role in determining the desirability of a golf club. The performance factors of maximizing distance while maintaining accuracy becomes even more prevalent in a metal wood type golf club head. Unlike iron type golf club heads where accuracy of a golf shot clearly trumps the distance benefits gained by any individual golf club, metal wood type golf club heads are designed to allow a golfer to hit the golf ball as far as possible in and as straight as possible.

In order to maximize distance while maintaining accuracy of a metal wood type golf club head, metal wood type golf clubs have been designed with the objective of maximizing the distance of a golf ball struck by a golf club head close to the geometric center of the golf club head. This geometric center of the golf club head, due to the inherent laws of physics, may generally produce a golf shot that maximizes the distance by reducing the energy loss between the golf ball and the golf club head. In order to quantify this value, the United States Golf Association (USGA), in conjunction with the golfing industry, have come up with various methods such as the calculation the Coefficient of Restitution (COR) or the calculation of the Characteristic Time (CT) as ways to quantify the rebounding characteristic of a golf ball after it impacts a golf club head.

U.S. Pat. No. 6,390,933 to Galloway et al. ('933 patent) discusses one of the methods to increase the COR of a golf club head by disclosing a golf club head having a coefficient of restitution greater than 0.845 and a durability to withstand 2000 impacts with a golf ball at 110 miles per hour, wherein the club head may be composed of three pieces, a face, a sole, and a crown. More specifically, the '933 patent discloses a golf club head that may be composed of a titanium material, having a volume in the range of 175 cubic centimeters to 400 cubic centimeters, a weight in the range of 165 grams to 300 grams, and a striking plate surface area in the range of 4.00 square inches to 7.50 square inches.

Focusing on accuracy instead of distance, U.S. Patent Publication No. 2004/0116202 to Lin ('202 patent Publication), discusses a method to increase the accuracy of a golf club head by disclosing a golf club head having a plurality of holes around the periphery of the club head, so that when the club head hits the golf ball, most of the vibration waves and sound waves generated are dispersed out of these holes thus improving accuracy of the direction of the striking golf ball.

However, upon closer examination, we can see that developments in maximizing distance while maintaining accuracy of a metal wood type golf club head are premised upon the fact that the golfer be capable of hitting the golf ball at the sweet spot. The sweet spot, generally coinciding with the geometric center of the golf club, may cover such a small area of the striking face of the golf club head, it may be difficult for the average golfer to consistently strike a golf ball in the sweet spot. Hence, in addition to the performance factors mentioned above, it may also be desirable to increase the size of this sweet spot, so an average golfer may obtain the design benefits of maximizing the distance and accuracy of the golf club head without having to strike the golf ball perfectly every time.

In order to address the issue that the golfer may not always strike a golf ball at the center of the striking face, the industry has attempted to experiment striking faces having different variable face thickness. In fact, different golf club heads may even have multiple zones with different thicknesses to improve the size of the sweet spot to allow the average golfer to achieve maximum results even when they do not hit the golf ball at the center of the striking face. Despite the fact that these methodologies may improve the size of the club head, they do not take into consideration the performance benefits that may be achieved by adjusting the actual geometry of the striking face of the golf club head.

It can be seen from above there is a need in the field for a golf club head that is capable of utilizing the geometry of the striking face of the golf club head itself to increase the size of the sweet spot of the golf club head. More specifically, there is a need in the field for a golf club head that allows the average golfer to achieve performance benefits similar to those achievable by the skilled professional golfer even when they do not strike the golf ball directly at the center of the golf club head.

BRIEF SUMMARY OF THE INVENTION

One aspect of the present invention is a golf club head comprising a striking face, a posterior body portion, and a beveled transition portion. The striking face may have a frontal surface area of greater than 3500 $mm^2$. The posterior body portion may further comprise a crown portion coupled to an upper portion of the striking face and a sole portion coupled to a lower portion of the striking face. The beveled transition portion is at least partially surrounding the perimeter of the striking face, connecting the striking face with the posterior body. The golf club head may have a sweet spot, defined as the area of the frontal surface of the striking face having at least 99.7% of the maximum ballspeed achievable by a golf club head, that encompasses greater than about 1.5% of the frontal surface area of the striking face.

In another aspect of the present invention is a golf club head comprising a striking face, a posterior body portion, and a beveled transition portion. The striking face may have a frontal surface area of greater than 3500 $mm^2$. The posterior body portion may further comprise a crown portion coupled to an upper portion of the striking face and a sole portion coupled to a lower portion of the striking face. The beveled transition portion is at least partially surrounding the perimeter of the striking face, connecting the striking face with the posterior body, wherein the beveled transition portion further comprises of at least a toe beveled transition portion and a heel beveled transition portion. The toe beveled transition portion may have a radius of curvature of greater than about 30 mm and the heel beveled transition portion may have a radius of curvature greater than about 25 mm.

In a further aspect of the present invention is a golf club head comprising a striking face and a posterior body portion. The striking face may have a frontal surface area of greater than 3500 $mm^2$. The posterior body portion may further comprise a crown portion coupled to an upper portion of the striking face and a sole portion coupled to a lower portion of the striking face. The frontal surface area of the striking face may further comprise a bulge radius spanning in an approximately horizontal direction across the frontal surface area of the striking face from a heel portion to a toe portion and a roll radius spanning in an approximately vertical direction across the frontal surface area of the striking face from a crown portion to a sole portion; wherein the bulge and roll radius are tilted in a direction of high toe to low heel.

These and other features, aspects, and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
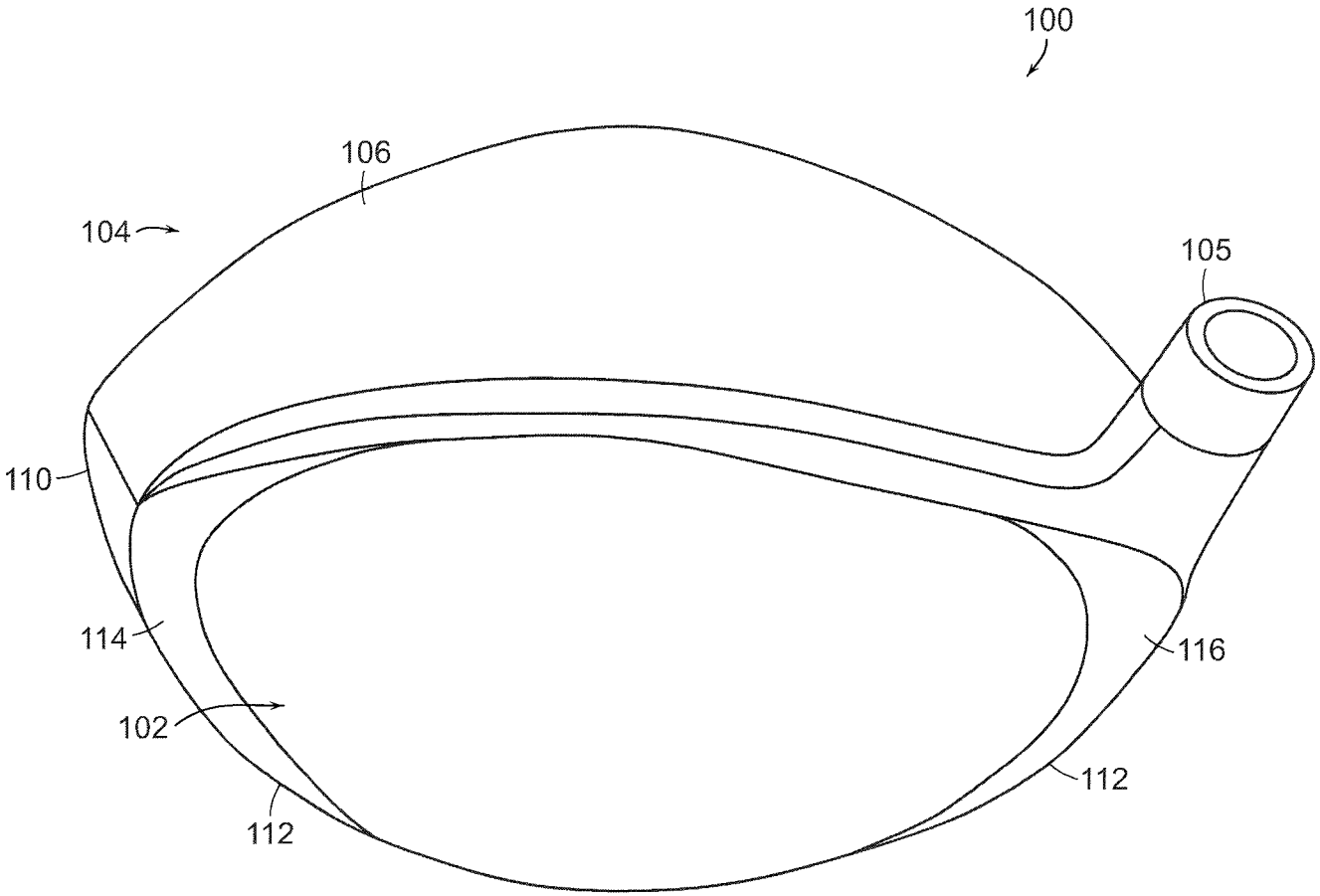
FIG. 1 is a frontal elevated view of a golf club head in accordance with an exemplary embodiment of the present invention.

FIG. 1 shows an elevated view of a golf club head 100 in accordance with an exemplary embodiment of the present invention. Golf club head 100 shown here in FIG. 1 may generally have a striking face 102, a posterior body portion 104 and a hosel 105. The posterior body portion 104 may generally be further comprised of a crown portion 106, a sole portion (not shown), and a skirt portion 110. The crown portion 106 may generally be connected to the upper portion of the striking face 102 while the sole portion (not shown) may generally be connected to the bottom portion of the striking face 102. The skirt portion 110, as shown in the current exemplary embodiment, may generally be juxtaposed between the crown portion 106 and the sole portion (not shown) to complete the posterior body portion 104. Golf club head 100, as shown in the current exemplary embodiment depicted by FIG. 1, may generally have a beveled transition portion 112 at least partially surrounding the perimeter of the striking face 102. More specifically, as we can see in FIG. 1, the beveled transition portion 112 may be further comprised of a toe beveled transition portion 114 and a heel beveled transition portion 116 surrounding the striking face 102 near the toe and heel portion of the striking face 102 respectively. It should be noted that although the current exemplary embodiment shown in FIG. 1 only shows the beveled transition portion 112 covering the toe and heel portion of the golf club head 100, the beveled transition portion 112 could completely surround the perimeter of the striking face 102 without departing from the scope and content of the present invention.

It should be noted in FIG. 1 that the striking face 102 may generally have a surface area of greater than about 3600 $mm^2$, more preferably greater than about 3700 $mm^2$, and most preferably greater than about 3750 $mm^2$. Additionally, the beveled transition portion 112 may generally have a surface area of less than about 850 $mm^2$, more preferably less than about 825 $mm^2$, and most preferably less than about 810 $mm^2$. Finally, the entire golf club head 100 may generally have a surface area of between about 32,000 $mm^2$ and about 35,000 $mm^2$. With the surface area value above, it is important to determine the ratio of the surface area of the striking face 102 relative to the total area of the entire golf club head 100. This striking face surface area ratio may generally be greater than about 9%, more preferably greater than about 10%, and most preferably greater than about 11%. Alternatively, the above surface areas may also yield a beveled transition portion surface area ratio. This beveled transition portion surface area ratio may generally be less than about 3.0%, more preferably less than about 2.75%, and most preferably less than about 2.5%.

Figure 2:
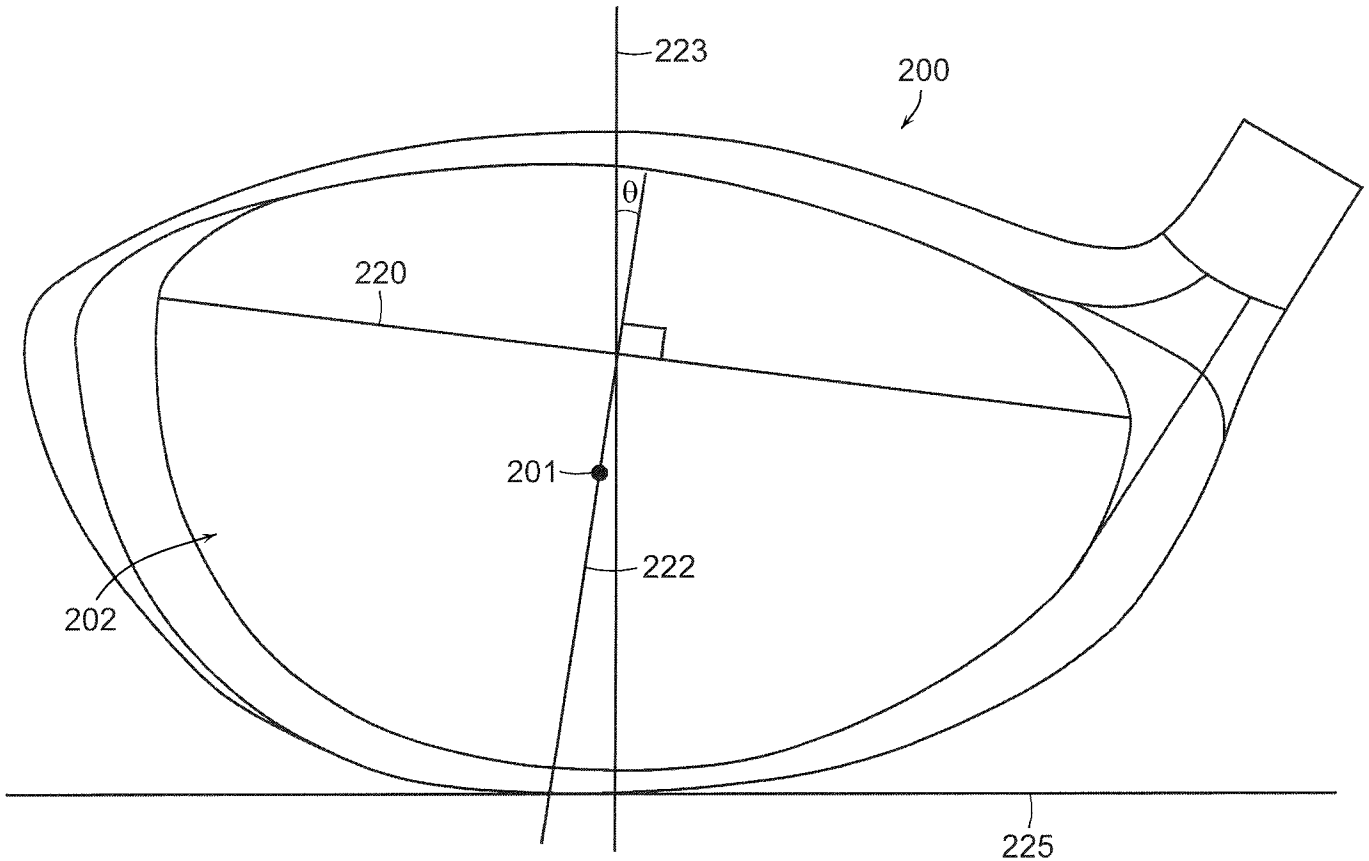
FIG. 2 is a frontal view of a golf club head in accordance with an exemplary embodiment of the present invention.

FIG. 2 shows a frontal view of a golf club head 200 in accordance with an exemplary embodiment of the present invention. This frontal view of the golf club head 200 allows a more direct view of the striking face 202 showing the striking face 202 being of a significantly elliptical shape; with a major axis 220 running in a significantly heel to toe direction and a minor axis 222 running in a significantly crown to sole direction. The striking face 202 of the golf club head 200 in accordance with an exemplary embodiment of the present invention may generally have an elliptical factor greater than about 0.33, more preferably greater than about 0.41, and most preferably greater than about 0.50. The elliptical factor discussed above may defined by Equation 1 below:

$$\text{Elliptical Factor} = \frac{\text{Length of Minor Axis 222}}{\text{Length of Major Axis 220}} \qquad \text{Eq. (1)}$$

The length of the major axis 220 may generally be defined as the distance of the longest line that can be drawn on the striking face 202. Here, in this current exemplary embodiment shown in FIG. 2, the major axis 220 spans in a direction that is significantly heel to toe; however the major axis 220 could be orientated in any other direction that deviates from the current orientation so long it represents the longest line that can be drawn on the striking face 202 all without departing from the scope and content of the present invention. Minor axis 222, as shown in the current exemplary embodiment, may generally be defined as a line across the striking face 202 that runs perpendicular to the major axis 220, while passing through the geometric center 201 of the striking face 202.

The length of the major axis 220, as shown in the current exemplary embodiment, may generally be less than about 120 mm, more preferably less than about 110 mm, and most preferably less than about 100 mm. The length of the minor axis 222 on the other hand, as shown in the current exemplary embodiment, may generally be greater than about 40 mm, more preferably greater than about 45 mm, and most preferably greater than about 50 mm. Hence, it can be seen that when the length of the minor axis 222 is divided by the length of the major axis 220, the resulting elliptical factor may generally be within the range discussed above.

The frontal view of golf club head 200 shown in FIG. 2 may also help illustrate how the striking face 202 of the golf club head 200 is tilted in a more upright position while keeping the golf club head 200 in a relatively flat position. Alternatively speaking, the vertical minor axis 222 of the striking face 202 may generally be tilted at an angle θ when compared to a vertical line 223 that is vertical to the ground 225. The angle θ, as shown in the current exemplary embodiment, may generally be greater than about 3.0 degrees and less than about 16.0 degrees, more preferably greater than about 3.0 degrees and less than about 12.0 degrees, and most preferably greater than about 3.0 degrees and less than about 8.0 degrees. As it can be seen from FIG. 2, the tilting of the striking face 202 of the golf club head 200 relative to the ground 225 will also cause the major axis 220 and minor axis 222 to tilt to the same extent and in the same direction. Viewed in another way, the tilt of the striking face 202 may also be defined as having the major axis 220 and the minor axis 222 both tilted in a direction of high toe to low heel by an angle of greater than about 3.0 degrees and less than about 16.0 degrees, more preferably greater than about 3.0 degrees and less than about 12.0 degrees, and most preferably greater than about 3.0 degrees and less than about 8.0 degrees.

Figure 3:
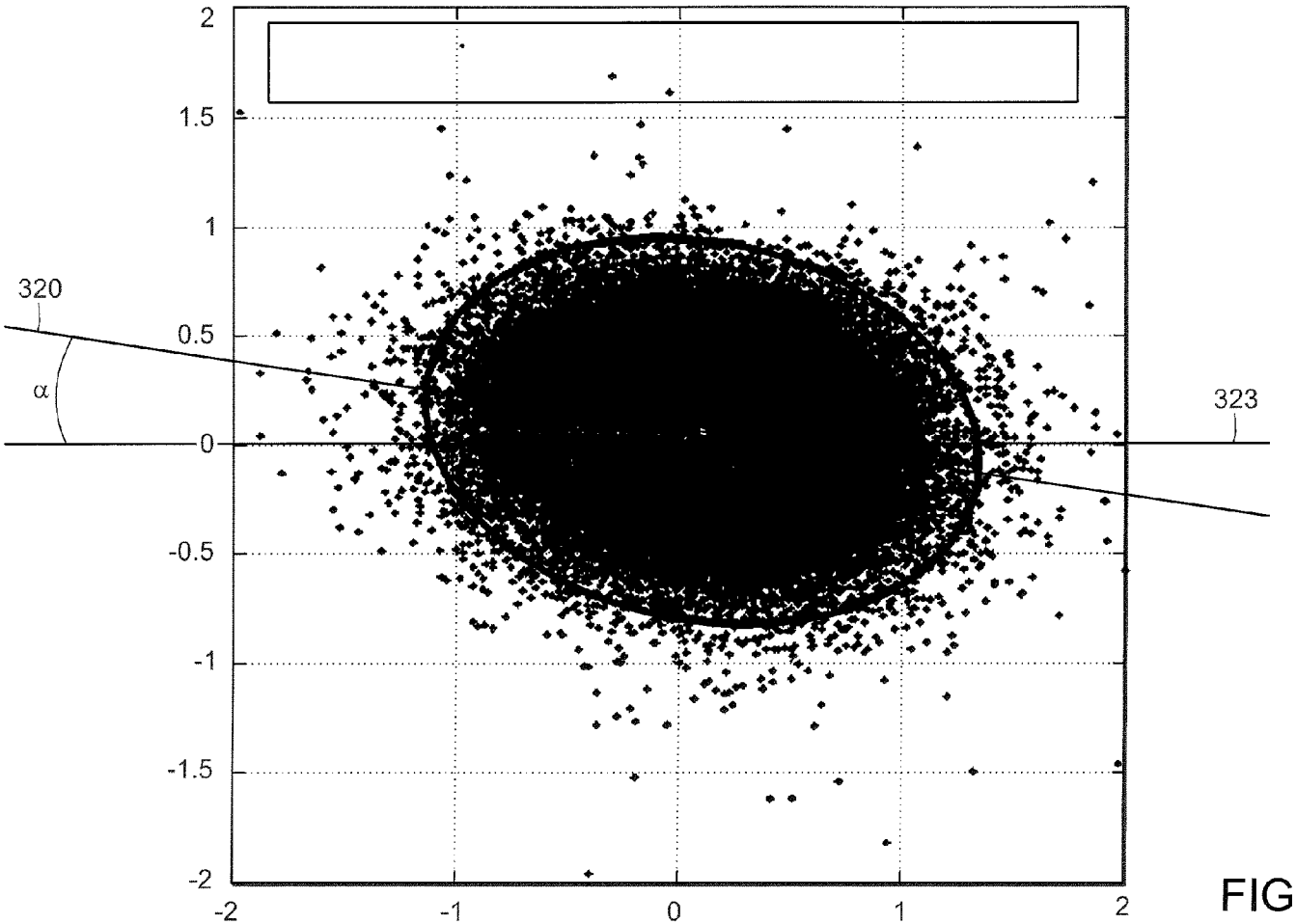
FIG. 3 is a graphical representation of a typical impact pattern between a golf club and a golf ball.

To understand the rationale behind the tilting of the striking face 202 of the golf club head 200, it may be beneficial to view FIG. 3 showing the typical impact pattern of a golfer relative to the striking face 202; with each of the dots on the graph representing a typical hit location when a golfer hits a golf ball with a golf club. As it has been reported in F. Werner and R. Greig, How Golf Clubs Really Work and How to Optimize Their Designs, Ch. 4, pp. 17-21 (2000), a typical distribution of golf ball hits on the face of a driver clubs follows an elliptical pattern with its major axis orientating in a direction from high toe to low heel, corresponding with the elliptical pattern shown in FIG. 3. Examining more closely the impact pattern shown in FIG. 3, we can determine that the major axis 320 of the impact pattern may form an angle α with the horizontal axis 323. This angle α may generally coincide with the tilt angle θ of the striking face 202 of the golf club head 200 shown in FIG. 2. More specifically, α may generally be greater than about 3.0 degrees and less than about 16.0 degrees, more preferably greater than about 3.0 degrees and less than about 12.0 degrees, and most preferably greater than about 3.0 degrees and less than about 8.0 degrees.

Returning to FIG. 2, we can see from the hit pattern shown in FIG. 3 that it may be desirable to tilt the striking face 202 of the golf club head 200 at an angle θ that corresponds to the tile angle α of the impact pattern. More important than the tilting of the striking face 202 of the golf club head 200 results in the tilting of the major axis 220 and the minor axis 222, as tilting the afore mentioned axes will allow the striking face 202 to be more in alignment with the typical hit pattern shown in FIG. 3.

Figure 4:
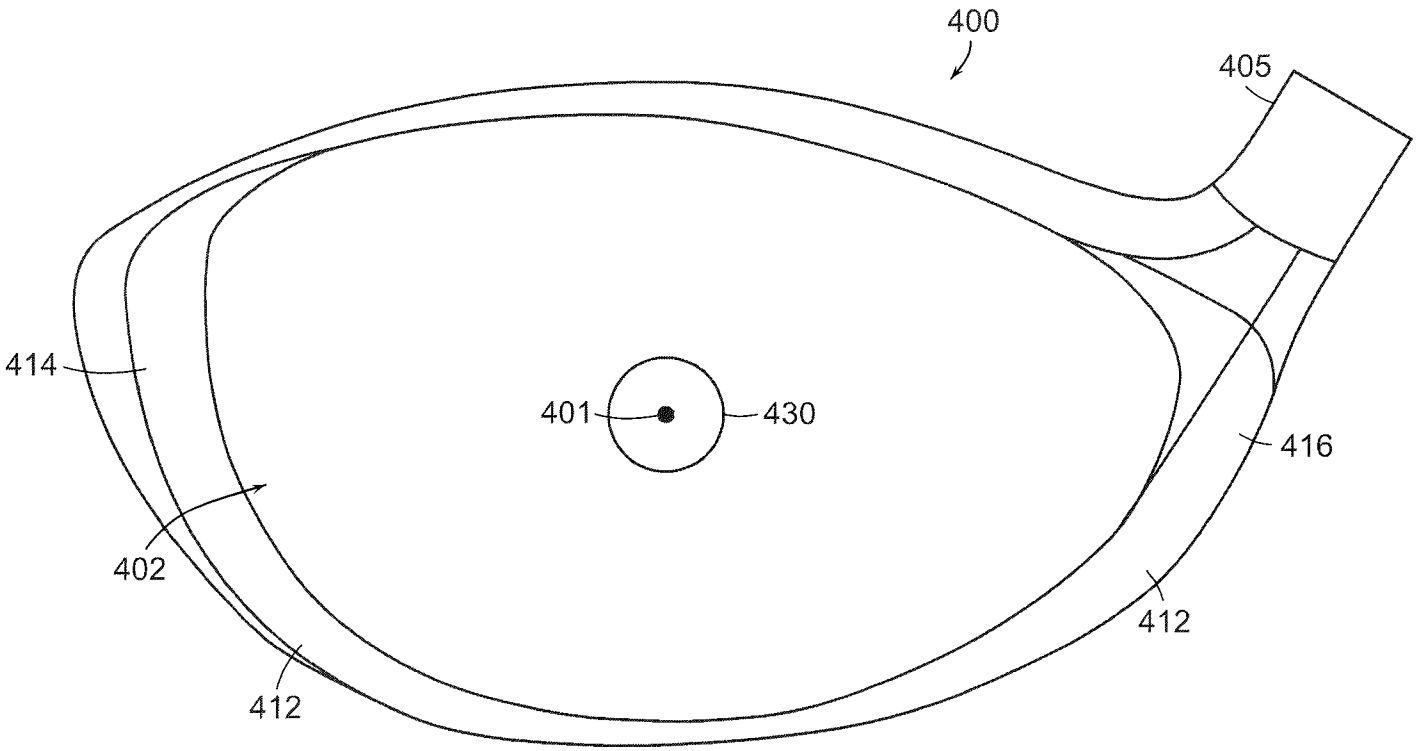
FIG. 4 is a frontal view of a golf club head showing the relative size, shape, and location of a sweet spot in accordance with an exemplary embodiment of the present invention.

Turning now to FIG. 4, showing another frontal view of a golf club head in accordance with an embodiment of the present invention, we can see that the golf club head 400 is shown with a sweet spot 430 located near the geometric center 401 of the striking face 402 of the golf club head 400. More specifically, the sweet spot 430 may generally be concentric with the geometric center 401 of the striking face 402 of the golf club head 400. One of the major advantage of a golf club head 400 designed in accordance with the present invention is that it may offer an improved sweet spot that is significantly larger than previously achievable. More specifically, a golf club head 400 in accordance with an exemplary embodiment of the present invention may have a sweet spot 430 that encompasses greater than about 1.5% of the total surface area of the striking face 402, more preferably greater than about 1.75% of the striking face 402, and most preferably greater than about 2.0% of the striking face 402. The sweet spot 430, within the context of the current application, may generally be defined as the area of the entire striking face 402 that is capable of achieving at least 99.7% of the maximum ballspeed achievable by the golf club head 400. The 99.7% value utilized in determining the size of the sweet spot 430 may be relevant, because a golf ball that is capable of achieving 99.7% of the maximum ballspeed only loses about ½ a mile per hour of ballspeed when compared to a direct central hit achieving 100% of the maximum ballspeed capable by the golf club head 400. The maximum ballspeed achievable by the golf club head 400, as shown in the current exemplary embodiment, may generally relate to the highest ballspeed that can be achieved by the golf club head regardless of where the golf club head 400 strikes a golf ball.

Here, shown in FIG. 4, the area of the striking face 402 of a golf club head 400 in accordance with an exemplary embodiment of the present invention may generally be greater than about 3600 $mm^2$, more preferably greater than about 3700 $mm^2$, and most preferably greater than about 3750 $mm^2$. The area of the sweet spot 430 on the other hand, may generally have an area greater than about 75 $mm^2$, more preferably greater than about 110 $mm^2$, and most preferably greater than about 120 $mm^2$. An better view of the sweet spot 430, showing its improved geometric profile may be shown later in FIGS. 6, 9, and 12; wherein it can focus on an enlarged ballspeed grid showing an enlarged view of the sweet spot 430. Considering the areas of the striking face 402 and the sweet spot 430 above, we can see that the sweet spot 430 encompasses greater than about 1.5% of the striking face 402, more preferably greater than about 1.75% of the striking face 402, and more preferably greater than about 2.0% of the striking face 402.

Figure 5:
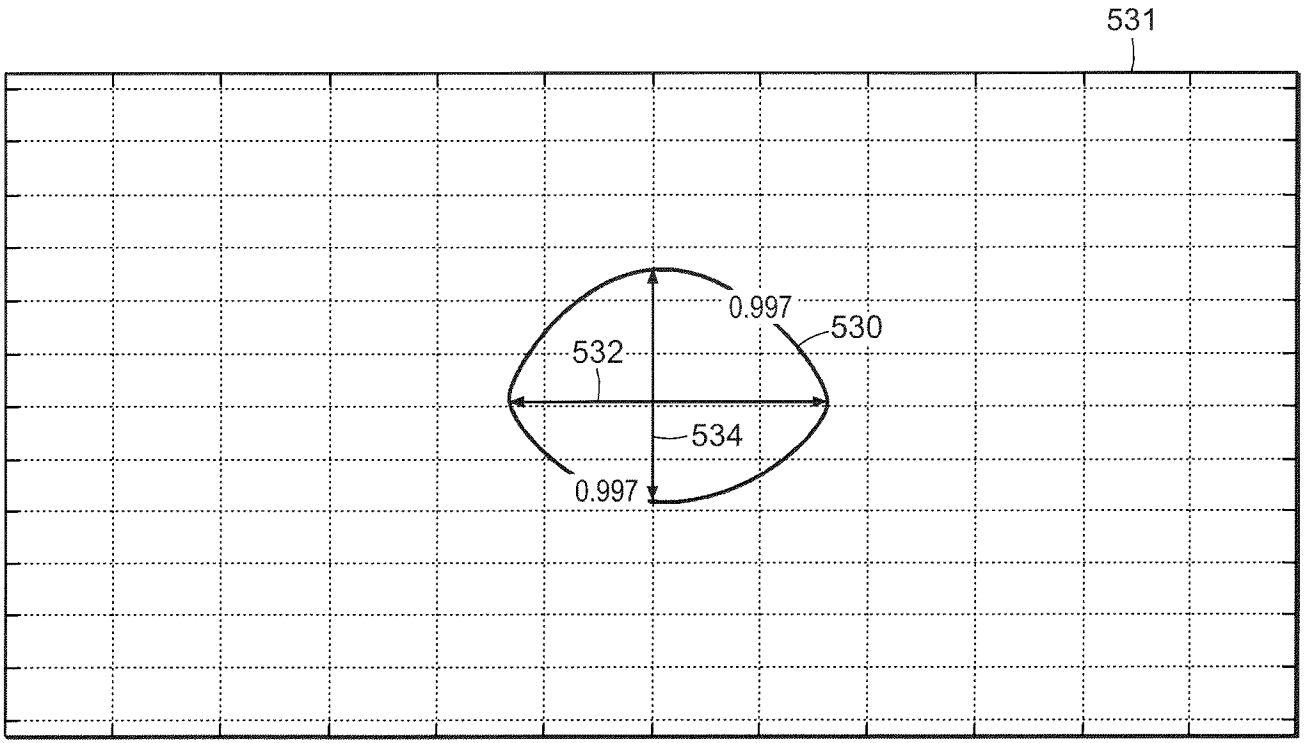
(Prior Art) FIG. 5
FIG. 5 is a graphical representation of an enlarged view of a prior art sweet spot associated with a prior art golf club head.

In order to properly explain the size of this improved sweet spot 430 in accordance with an exemplary embodiment of the present invention, it may be worth while to examine the sweet spot size that is generally attributed to the striking face portion of a prior art golf club head. FIG. 5 shows the sweet spot 530 of a prior art golf club head that has at least 99.7% of the maximum ballspeed within a ballspeed grid 531 located on the striking face of a prior art golf club head. The ballspeed grid 531, as defined in this context, may generally be rectangular area located on the striking face of a golf club head with a dimension of 40 mm in width by 20 mm in height. The sweet spot 530 of a normal prior art golf club head may generally have an area of about 45 $mm^2$, which is significantly smaller than the sweet spot area 430 achievable by a golf club head 400 in accordance with an exemplary embodiment of the present invention.

It is also worth noting that this prior art sweet spot 530 shown in FIG. 5, in addition to being significantly small in size, also suffers from a less than optimal shape. More specifically, this prior art sweet spot 530 has a significantly elliptical shape, with a major axis 532 spanning in a significantly horizontal direction and a minor axis 534 spanning in a significantly vertical direction. A closer examination of this prior art sweet spot 530 within this prior art golf club head may show that the major axis is significantly longer than the minor axis of the sweet spot, wherein the circumference of the sweet spot at the horizontal ends along the major axis may be a significantly further distance away from the circumference of the sweet spot at the vertical end. This elliptical sweet spot 530 may be undesirable because it fails to capture the extremities of a typical impact pattern shown in FIG. 3, especially when the misses are at a location that is high toe or low heel.

Figure 6:
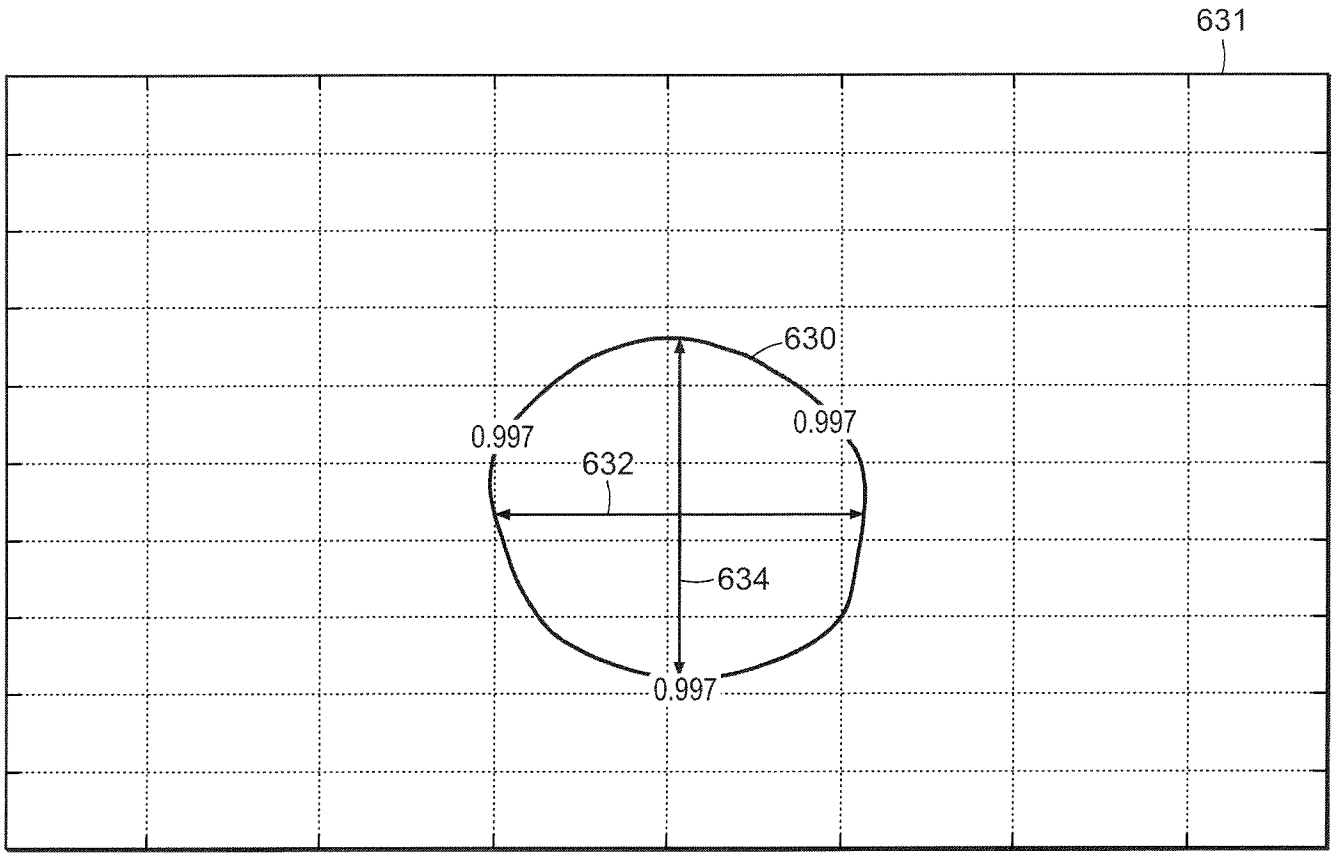
FIG. 6 is a graphical representation of an enlarged view of an improved sweet spot in accordance with an exemplary embodiment of the present invention.

FIG. 6 shows the sweet spot 630 of a golf club head in accordance with an exemplary embodiment of the present invention within a ballspeed grid 631 of the same size. First and foremost, as it can be seen from FIG. 6, the size of the sweet spot 630 is significantly bigger than the size of the prior art sweet spot 530 shown in FIG. 5. More specifically, the sweet spot 630 shown in this current exemplary embodiment may generally have an area of about 75 $mm^2$, which may be the result of the enhanced face geometry shown before in FIG. 2. In addition to the larger sweet spot 630, the improved sweet spot 630 may also have an improved shape that is more circular, allowing the sweet spot 630 to capture more of the impact region shown in FIG. 3. More specifically, the sweet spot 630, as shown in the current exemplary embodiment in FIG. 6, may generally be of a more circular shape, with a major axis 632 and a minor axis 634 being approximately the same length. Alternatively speaking, no point along the circumference of the sweet spot 630 may be more than about 5.0 mm away from the geometric center of the sweet spot 630 while maintaining a sweet spot 630 area of about 75 $mm^2$.

Figure 7:
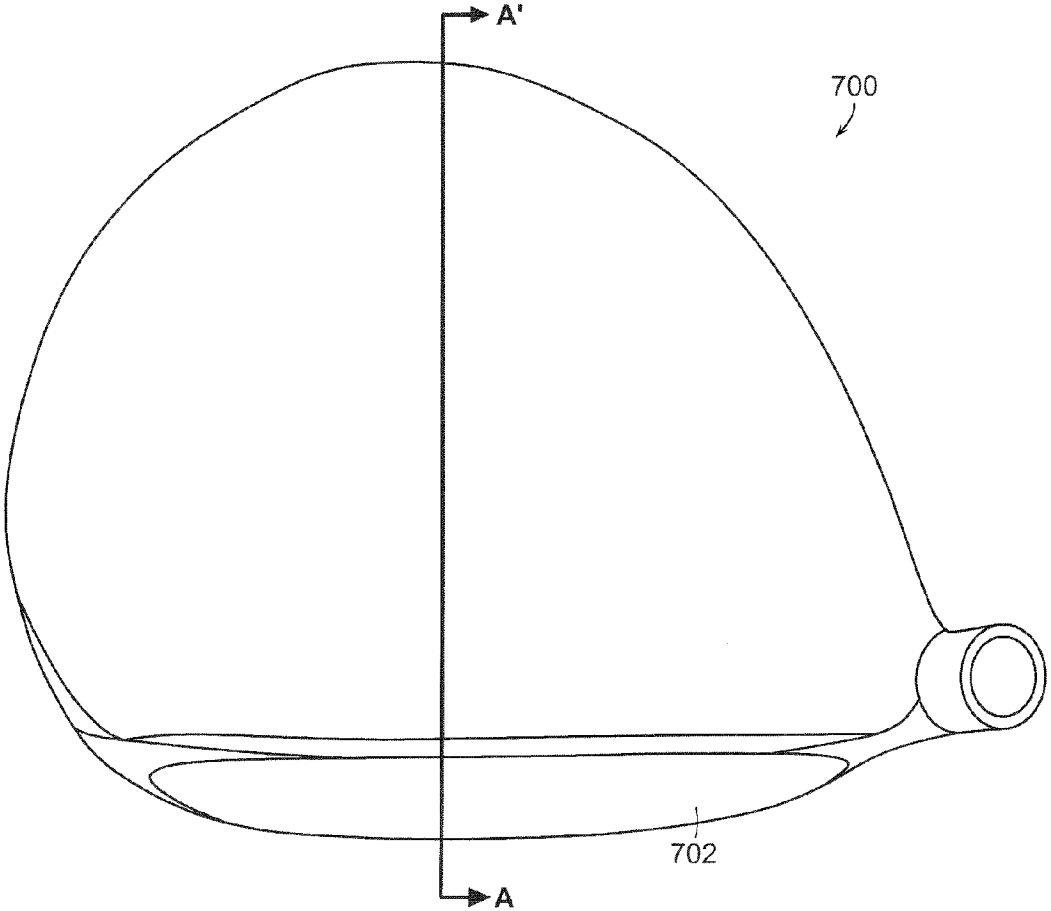
FIG. 7 is a top view of a golf club head in accordance with an exemplary embodiment of the present invention.
Figure 8A:
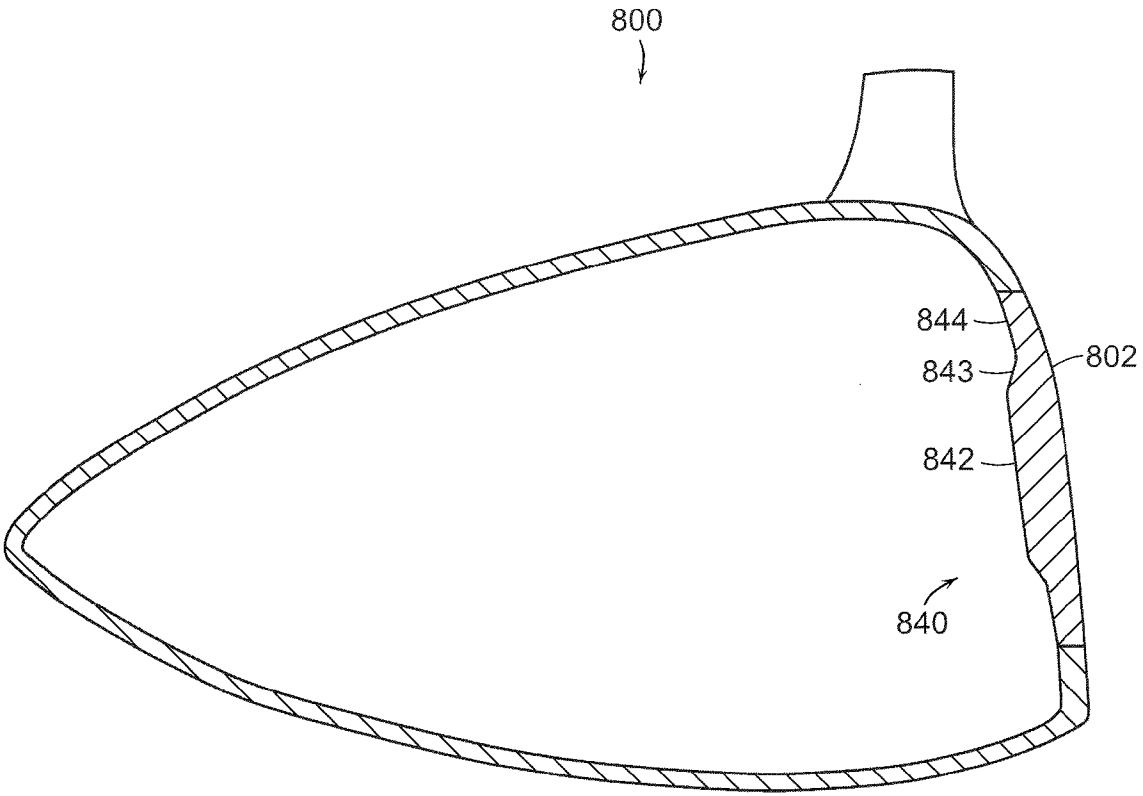
FIG. 8*a* is a cross-sectional view of a golf club head in accordance with an exemplary embodiment of the present invention taken along cross-sectional line A-A' as shown in FIG. 7.

Although the enhanced face geometry shown in FIG. 2 may improve the size and shape of the sweet spot 630 shown in FIG. 6, a further exemplary embodiment of a golf club head shown in FIG. 7 and FIG. 8 may provide additional features and benefits that could further enhance the performance of a golf club head 200 shown in FIG. 2. Turning now to FIG. 7 which shows a top view of a golf club head 700 in accordance with a further exemplary embodiment of the present invention having a striking face 702 with a variable face thickness. Although the variable face thickness can not be seen from FIG. 7, FIG. 7 provides a cross sectional line A-A' across the center of the golf club head 700, allowing a cross sectional profile of golf club head 700 to be shown in FIG. 8*a* with a variable face thickness profile.

FIG. 8*a* shows a cross sectional view of the golf club head 700 taken along cross sectional line A-A' shown in FIG. 7. Golf club head 800, as shown in this current exemplary embodiment in FIG. 8*a*, may have a striking face 802 with a variable face thickness profile 840 behind the striking face 802. More specifically, the variable face thickness profile 840, as shown in the current exemplary embodiment, may generally be comprised of a thick central portion 842 surrounded by a transition portion 843, which is then surrounded by a thin perimeter portion 844. Because the striking face 802 of a golf club head 800 deforms like a trampoline when striking a golf ball, having a variable face thickness profile 840 allows the thin perimeter portion 844 of the striking face 802 to be thin enough to provide a trampoline effect while the thick central portion 842 of the variable face thickness profile 840 provides sufficient thickness to endure the stresses associated with a golf ball impact. Because the beveled transition portion 112 (shown in FIG. 1) may provide additional structural stiffness to the striking face 802 of the golf club head 800, the striking face 802 of the golf club head may be made thinner to create an even bigger sweet spot. More specifically, the increased structural stiffness may allow the thickness of the thin perimeter portion 844 to be less than about 3.0 mm thick, more preferably less than about 2.9 mm thick, and most preferably less than about 2.8 mm thick. More detailed disclosure regarding using variable face thickness to improve the performance of a golf club head may be found in U.S. Pat. No. 7,029,403 to Rice et. al., the disclosure of which is incorporated by reference in its entirety.

Figure 8B:
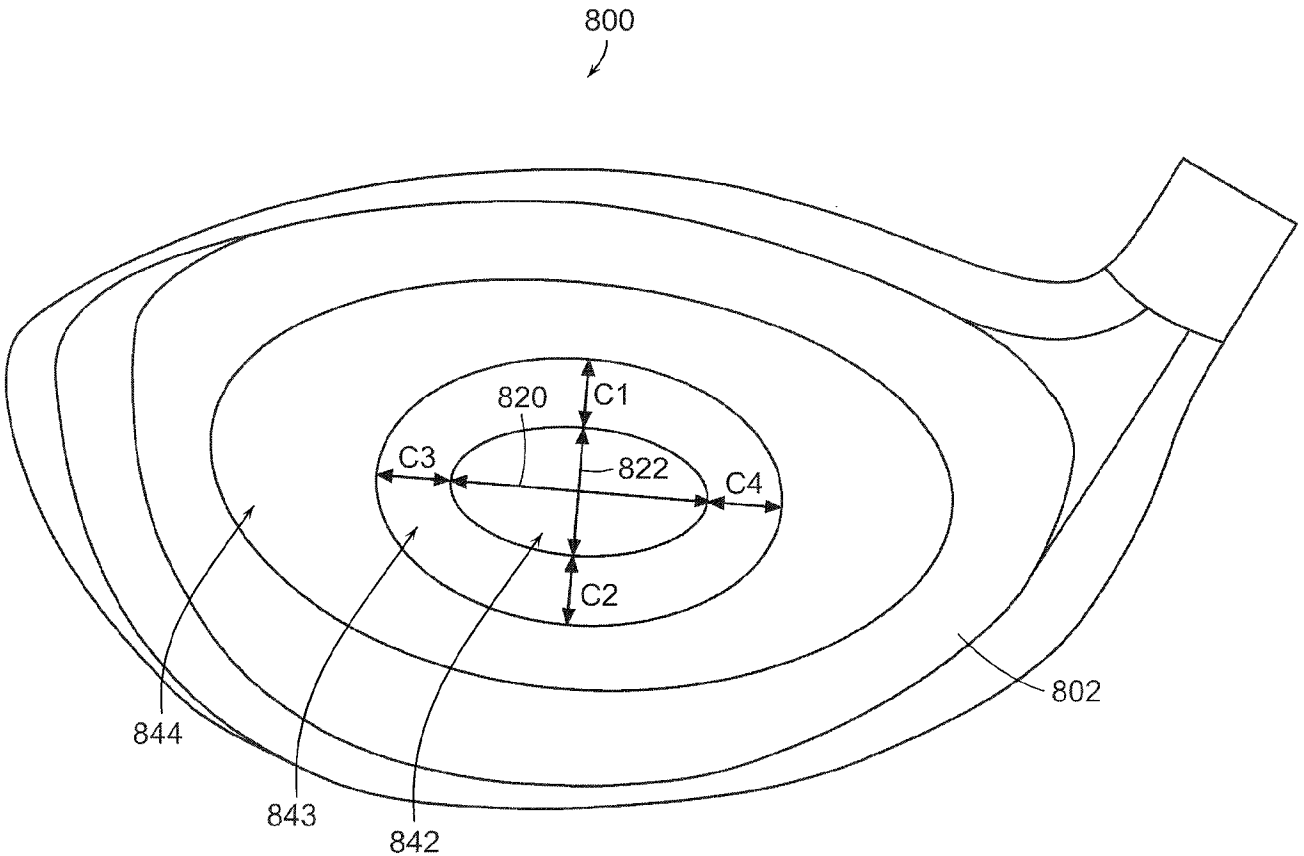
FIG. 8*b* is a frontal view of the golf club head in accordance with an exemplary embodiment of the present invention showing the geometry behind the striking face.

FIG. 8*b* shows a frontal view of the internal geometry of a golf club head 800 with a variable face thickness profile 840. More specifically, FIG. 8*b* shows the relative size and position of the central portion 842, the transition portion 843, and the thin perimeter portion 844. Although not specifically labeled in FIG. 8*b*, because the striking face 802 of the golf club head 800 is tilted in a direction that is high heel to low toe, the variable face thickness profile 840 may be tilted in a direction of high toe to low heel by an angle θ. The angle θ, as previously discussed in FIG. 2, may generally be greater than about 3.0 degrees and less than about 16.0 degrees, more preferably greater than about 3.0 degrees and less than about 12.0 degrees, and most preferably greater than about 3.0 degrees and less than about 8.0 degrees.

It is also worth noting here in FIG. 8*b* that the central portion 842 may generally have an elliptical profile shape with a major axis 820 running substantially in a direction of heel to toe and a minor axis 822 running substantially in a direction of crown to sole. The shape and proportion of the central portion 842, defined by the relative length of the major axis 820 and the minor axis 822, may generally correlate with the Elliptical Factor as previously discussed in FIG. 2. The central portion 842 of the striking face 902 in accordance with an exemplary embodiment of the present invention may generally have an elliptical factor greater than about 0.33, more preferably greater than about 0.41, and most preferably greater than about 0.50, calculated based on Eq. (1) above.

This enlarged view of the variable face thickness profile 840 also shows an interesting relationship of the different widths of the perimeter of the transition portion 843 relative to the central portion 842. More specifically, as we can see from FIG. 8*b*, the transition portion 843 may have a variable transition width C1, C2, C3, or C4 depending on where the width measurement is taken. The transition width C1, C2, C3, and C4 may have different values resulting in a shift in the placement of the central portion 842 within the transition portion 843 without departing from the scope and content of the present invention. "Transition width", as used herein, may generally refer to the distances C1, C2, C3, and C4, signifying the distance between the perimeter of the central portion 842 and the perimeter of the transition portion 843 measured from a point that is normal to a tangent line taken at that point across the perimeter of the central portion 842.

Alternatively speaking, the geometric center of the central portion 842 shown in FIG. 8*b* may be offset from the geometric center of the transition portion 843 within the two dimensional plane shown in FIG. 8*b*. In one exemplary embodiment of the present invention, the transition width C1 near the top of the transition portion 843 may generally be greater than the transition width C2 near the bottom of the transition portion 843. More specifically, transition width C2 may generally equal to about 80% of the transition width C1 to improve the performance of the variable face thickness profile 840. This ratio of a wider transition width C1 compared a narrower transition width C2, may yield a central portion 842 that sits closer to the bottom or sole of the striking face 802 with a placement that is sole biased. In the current exemplary embodiment of the present invention, the transition width C1 may generally be greater than about 8.0 mm, while the width C2 may generally be about less than about 7.0 mm. More specifically, transition width C1 may generally be about 8.5 mm, while transition width C2 may generally be about 6.8 mm. However, in other alternative embodiment of the present invention, the transition width C2, may be wider than transition width C1 to create a central portion 842 that sits closer to the top or crown of the striking face 802 without departing from the scope and content of the present invention.

Other than changing the transition width C1, and C2 of the transition portion 843 along the minor axis 822, it should be noted that the transition width C3 and C4 along the major axis 820 may adjusted to further adjust the size and placement of the central portion 842 within the transition portion 843 without departing from the scope and content of the present invention. In fact, the current invention could involve the adjustment of all of the transition widths C1, C2, C3, and C4 simultaneously all without departing from the scope and content of the present invention. In on exemplary embodiment of the present invention, transition width C3 and C4 may be about the same width as transition width C1 to yield a more centralized placement of the central portion 842 within the transition portion 843. In an alternative embodiment of the present invention, transition widths C3 or C4 may be greater than transition width C1 to further adjust the size or placement of the central portion 842 also without departing from the scope and content of the present invention. In a further alternative embodiment of the present invention, transition widths C3 and C4 may generally be greater than about 8.0 mm, more preferably greater than about 8.2 mm, and most preferably greater than about 8.3 mm.

Figure 9:
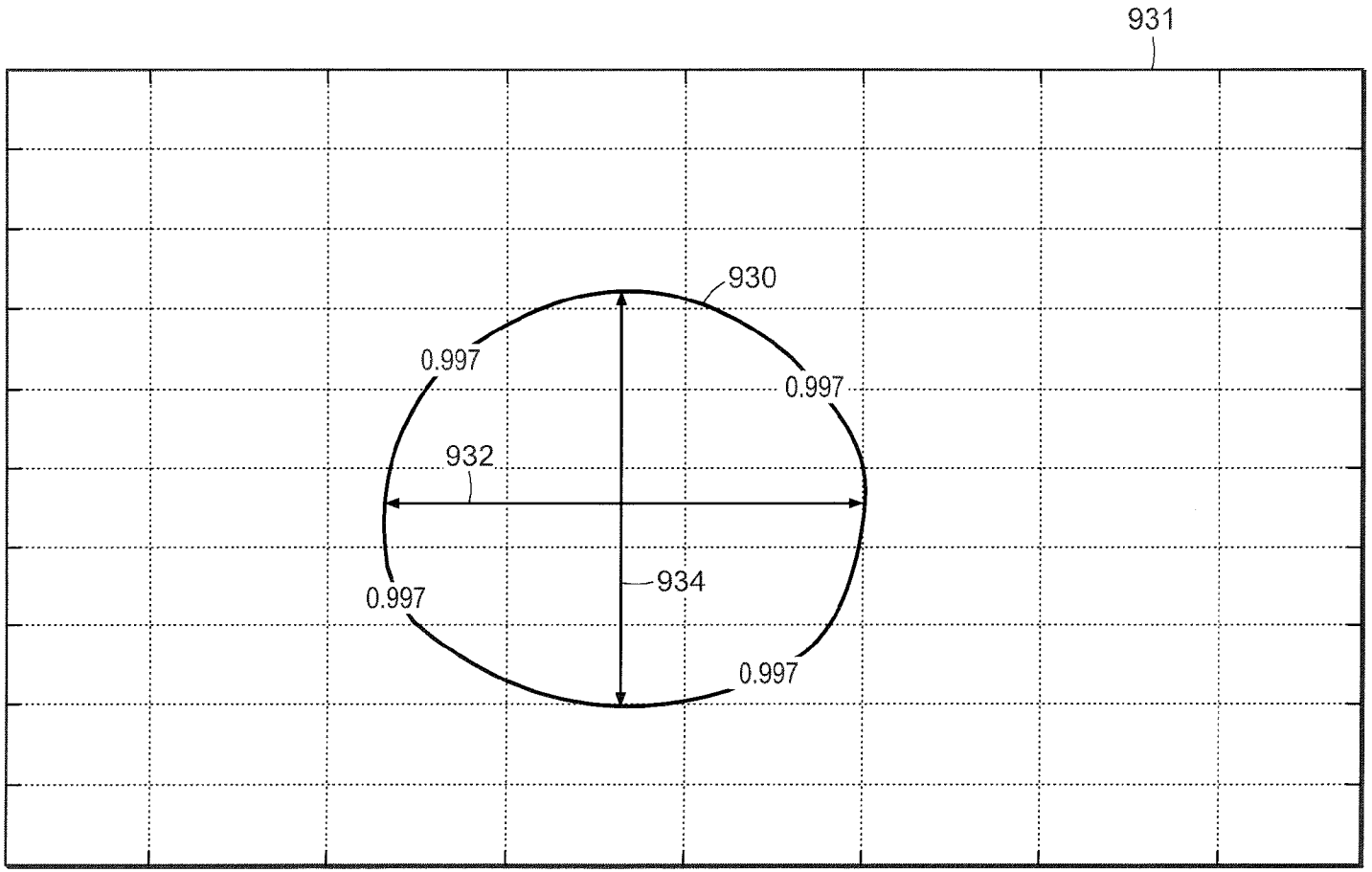
FIG. 9 is a graphical representation of an enlarged view of an improved sweet spot in accordance with an exemplary embodiment of the present invention.

FIG. 9 shows a sweet spot 930 in accordance with a further exemplary embodiment of the present invention utilizing both the enhanced face geometry shown in FIG. 2 and the variable face thickness profile shown in FIG. 8. As it can be seen from FIG. 9 utilizing a ballspeed grid 931 of the same size as previously shown, the size of the sweet spot 930 is significantly larger than any of the previous plots. More specifically, the size of the sweet spot 930, corresponding to a golf club head 900 incorporating the enhanced face geometry as well as the variable face thickness profile, may generally have an area that is about 110 $mm^2$. In addition to the larger sweet spot 930, the sweet spot 930 may also have a shape that is more circular, allowing the sweet spot 930 to encompass more of the impact region shown in FIG. 3. Similar to what is already described in FIG. 6, the sweet spot 930 may generally be of a more circular shape wherein no point along the circumference of the sweet spot 930 may be more than about 6.0 mm away from the geometric center of the sweet spot 930 while maintaining a sweet spot 930 area of about 110 $mm^2$.

Figure 10:
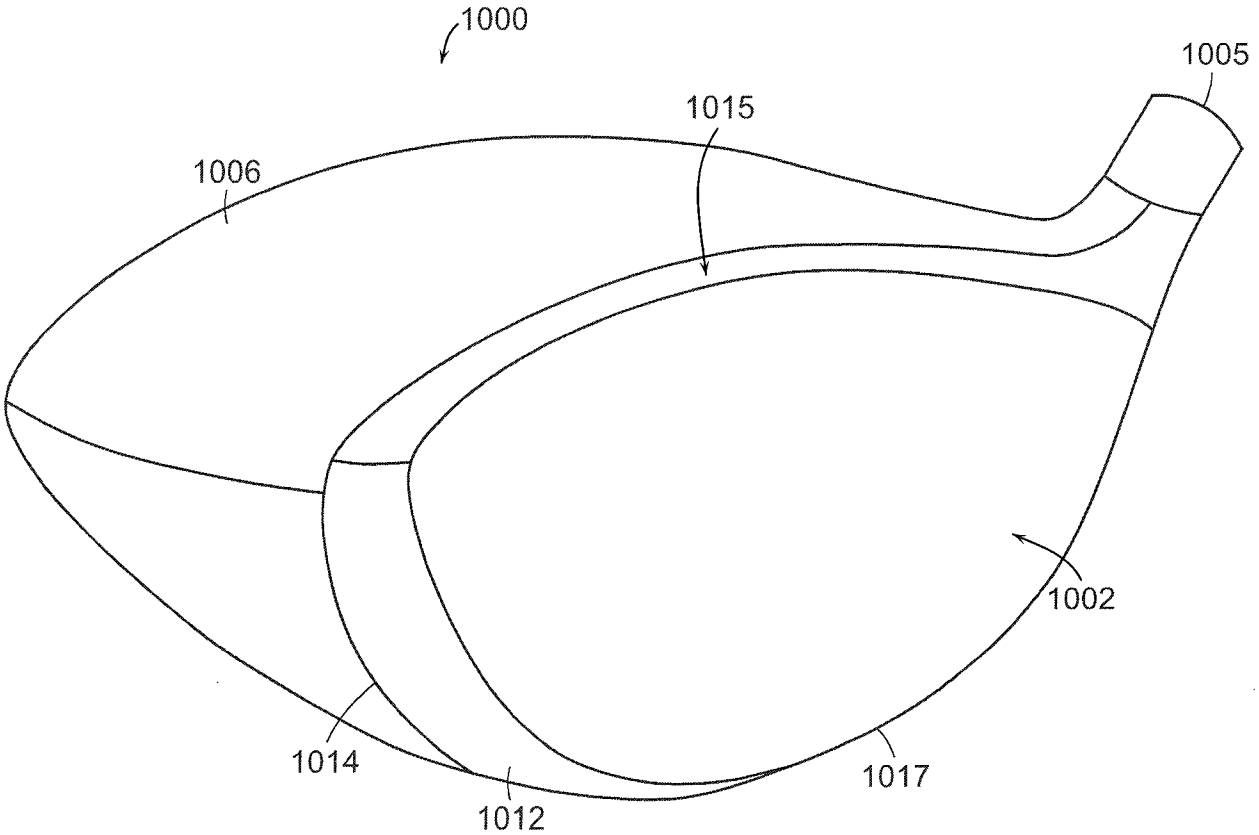
FIG. 10 is a toe biased perspective view of a golf club head in accordance with an exemplary embodiment of the present invention.
Figure 11:
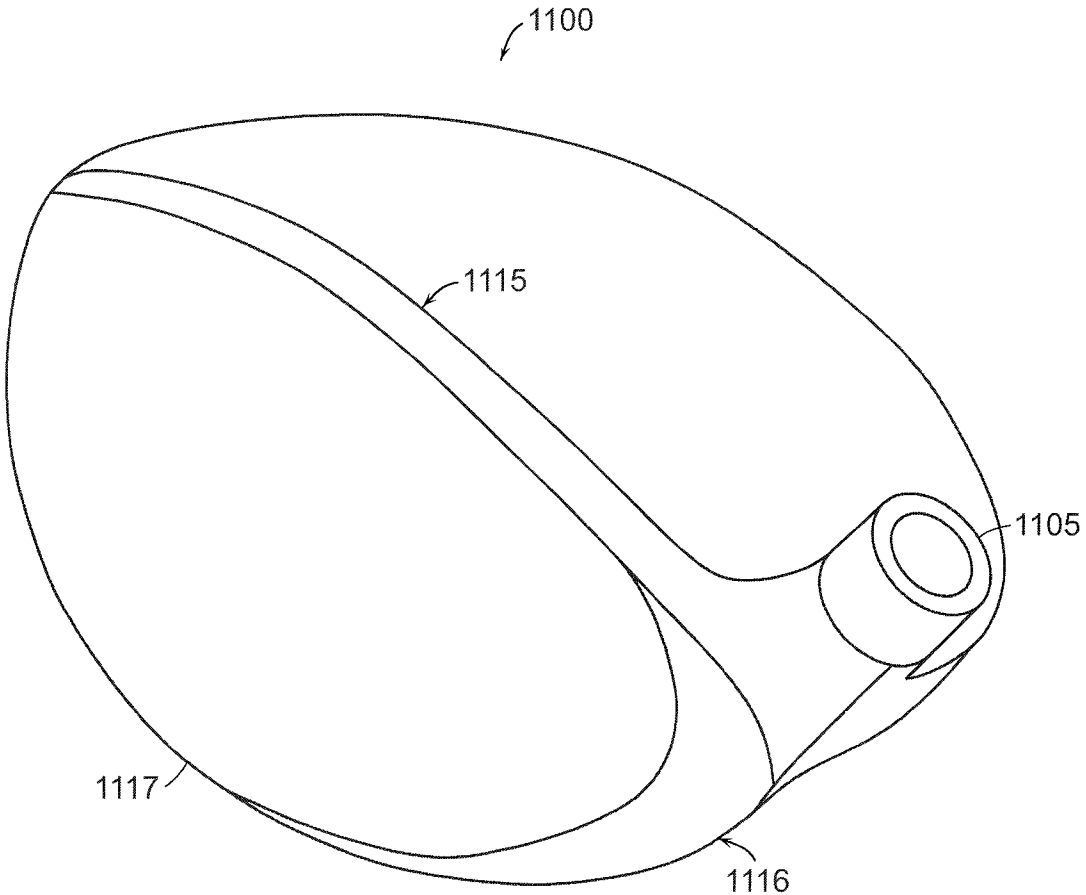
FIG. 11 is a heel biased perspective view of a golf club head in accordance with an exemplary embodiment of the present invention.
Figure 12:
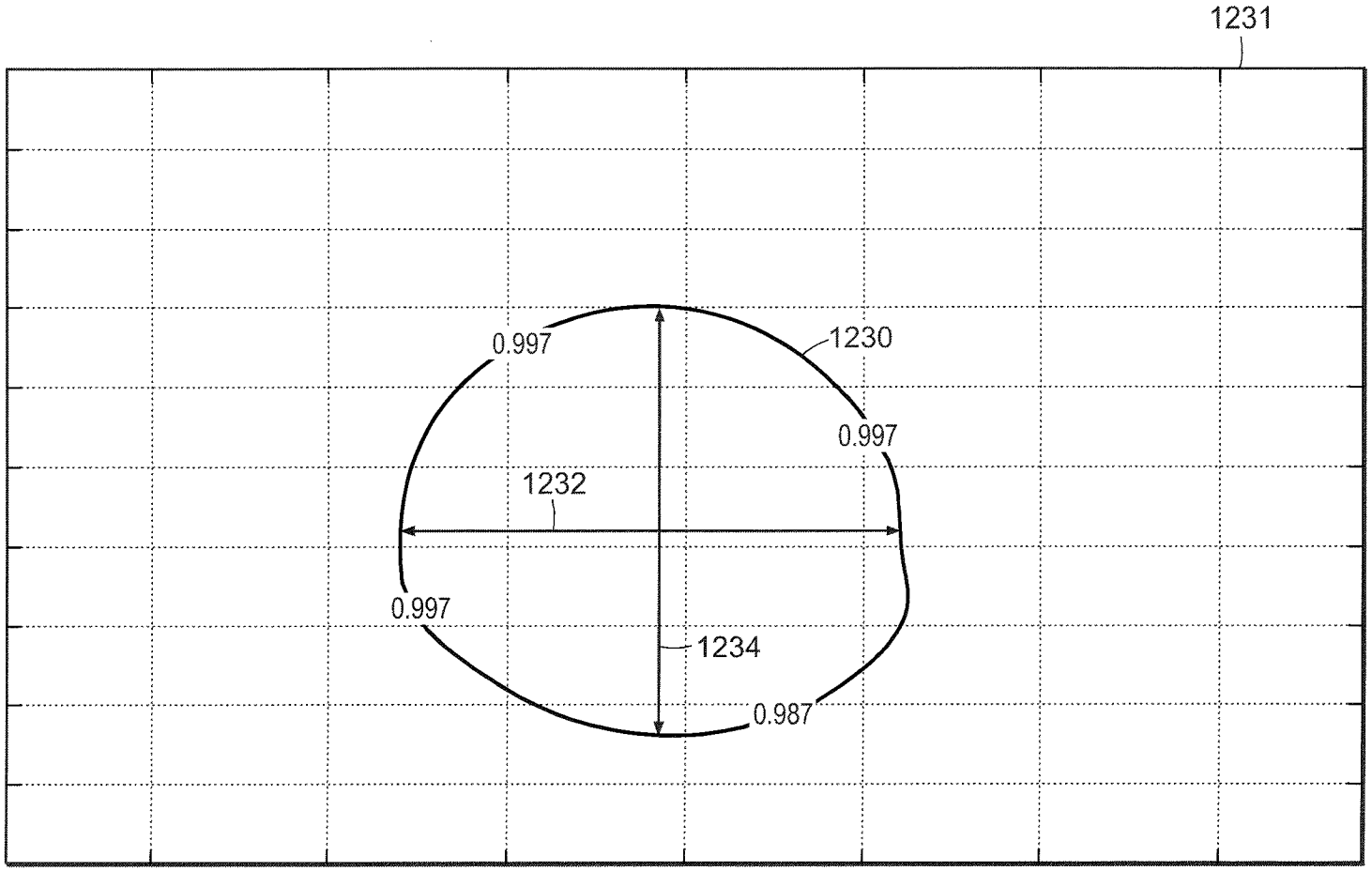
FIG. 12 is a graphical representation of an enlarged view of an improved sweet spot in accordance with an exemplary embodiment of the present invention.

FIGS. 10, 11, and 12 show further alternative embodiments of the present invention wherein the beveled transition portion that at least partially surrounds the striking face could further improve the performance of a golf club by further enlarging the size of the sweet spot. More specifically, because the beveled transition portion at least partially surrounds the striking face, the beveled transition portion could provide additional structural stiffness, allowing the striking face to be made thinner. A golf club head with a thinner striking face could be beneficial to the performance characteristics because it allows for more discretionary weight that could be distributed around the striking face of a golf club head to create a larger sweet spot by adjusting the thickness of the various portions all without departing from the scope and content of the present invention.

In addition to the above, the beveled transition portion could also improve the confidence factor of a golfer when the golfer attempts to hit a golf ball using the golf club head. Because golfers are accustomed to a golf club having a specific shape and geometry, dramatic deviation of the shape and geometry of a golf club from the traditional shape and size could cause a golfer to be distracted by an abnormal shape and geometry; causing him to lose confidence. Because the elliptical factor above that improves the performance of a golf club head causes the striking face portion of the golf club head to deviate from the conventional shape and size, some may consider a golf club head with such a shape, size, and geometry to be unconventional. The beveled transition portion helps address this issue by taking away extraneous material from the perimeter of the striking face bringing the golf club back into a more traditional shape. More specifically, the beveled transition portion may have a higher radius of curvature around the toe and heel portion to recapture the traditional shape and geometry of a golf club head to inspire confidence to a golfer.

FIG. 10 shows a perspective of an inventive golf club head 1000 in accordance with an exemplary embodiment of the present invention viewed from the toe portion of the golf club head 1000. This toe biased perspective view of the golf club head 1000 shows the beveled transition portion 1012 around the toe portion of the golf club head. More specifically, FIG. 10 illustrates the various radius of curvature around the striking face 1002 that can be used to create the beveled transition portion 1012. The radius of curvature for the crown transition portion 1015 of the golf club head 1000, between the striking face 1002 and the crown 1006, may generally be less than about 5 mm, more preferably less than about 3 mm, and most preferably less than about 2 mm. The radius of curvature for the toe beveled transition portion 1014 on the other hand, may generally be variable in order to create a proper transition between the crown transition portion 1015 and the sole transition portion 1017. More specifically, the radius of curvature for the toe beveled transition portion 1014 may generally be greater than about 25 mm at its flattest point, more preferably greater than about 30 mm at its flattest point, and most preferably greater than about 35 mm at its flattest point. Hence, it can be seen from FIG. 10 that although the crown transition portion 1015 may generally have a constant radius of curvature, the toe beveled transition portion 1014 may have a varying radius of curvature from about 2 mm to about 35 mm to ensure a smooth transition between the two transition portions. It is worth noting here that although the toe transition portion 1014 may generally refer to the toe portion of the perimeter of the striking face 1002, it may extend into the crown transition portion 1015 or even the sole transition portion 1017 to smooth out the transition between the varying radius of curvature without departing from the scope and content of the present invention.

FIG. 11 shows a perspective of an inventive golf club head 1100 in accordance with an exemplary embodiment of the present invention viewed from the heel portion of the golf club head 1100. Similar to FIG. 10, the golf club head 1100 has a crown transition portion with the same radius of curvature as discussed earlier in FIG. 10. FIG. 11, however, shows a heel beveled transition portion 1116 having a radius of curvature of greater than about 20 mm at its flattest point, more preferably greater than about 25 mm at its flattest point, and most preferably greater than about 27.5 mm at its flattest point. Similar to the toe beveled transition portion 1014 (shown in FIG. 10), the heel beveled transition portion 1116 may also have a variable radius of curvature from about 2 mm to about 27.5 mm to ensure a smooth transition between the two transition portions. The heel beveled transition portion 1116 may extend into the crown transition portion 1115 or even the sole transition portion 1117 to smooth out the transition between the varying radius of curvature also without departing from the scope and content of the present invention.

FIG. 12 shows a sweet spot 1230 of a golf club head in accordance with the further exemplary embodiment of the present invention utilizing the enhanced face geometry shown in FIG. 2, the variable face thickness profile shown in FIG. 8, and the beveled transition portion shown in FIGS. 10 and 11. As it can be seen from FIG. 12, utilizing a ballspeed grid 1231 of the same size as previously shown, the size of the sweet spot 1231 is significantly larger than any of the previous plots. More specifically, the size of the sweet spot 1230, corresponding to a golf club head 1200 incorporating all of the above mentioned features, may generally have an area that is about 120 $mm^2$. In addition to the larger sweet spot 1230, the sweet spot may also be more of a circular shape, with no point along the circumference of the sweet spot 1230 being more than 7.0 mm away from the geometric center of the sweet spot 1230 while maintaining a sweet spot 1230 area of about 120 $mm^2$.

Figure 13:
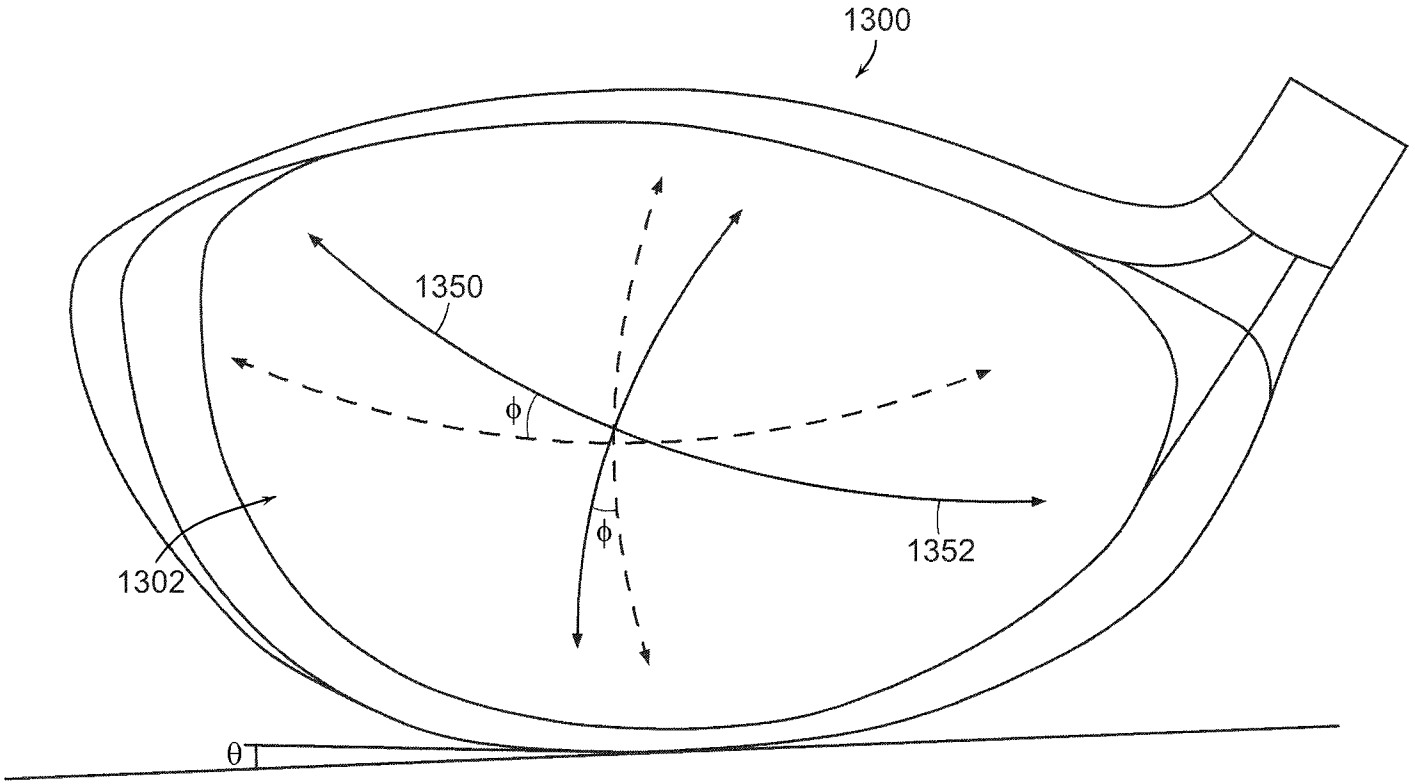
FIG. 13 is a frontal view of a golf club head showing a tilted bulge and roll radius in accordance with an exemplary embodiment of the present invention.

FIG. 13 shows a further alternative embodiment of the present invention wherein the striking face 1302 may have a tilted bulge radius 1350 as well as a tilted roll radius 1352 to help improve the performance of a golf club head. Bulge radius 1350 may refer to the curvature of the striking face 1302 spanning in an approximately horizontal direction across the striking face 1302 from a heel portion to a toe portion. Roll radius 1352, on the other hand, may generally refer to the curvature of the striking face 1302 spanning in an approximately vertical direction across the striking face 1302 from a crown portion to a toe portion. Although the tilted bulge radius 1350 and the tilted roll radius 1352 may not further enlarge the size of the sweet spot of a golf club head, it could help correct for mis-struck shots by imparting corrective spin on a golf ball. More detailed discussion of the effect of having a striking face 1302 with a bulge radius 1350 and a roll radius 1352 may be found in U.S. Pat. No. 6,595,869 to McCabe et al., the disclosure of which is incorporated by reference in its entirety.

It should be worth noting that in this current exemplary embodiment shown in FIG. 13, the striking face 1302 of the golf club head 1300 is tilted more upright by an angle θ, as already shown in FIG. 2. As mentioned earlier, this angle θ may align the majority of the striking face 1302 with the impact pattern of a normal golfer shown in FIG. 3. However, without any adjustment to the bulge radius 1350 and the roll radius 1352, the compensation of the bulge and roll in terms of spinning the golf ball back into the central portion may no longer be correctly matched. Hence, it may be desirable to tilt the bulge radius 1350 and the roll radius 1352 more upright by an angle Φ of greater than about 1 degree and less than about 16 degrees, more preferably greater than about 1 degree and less than about 12 degrees, and most preferably greater than about 1 degree and less than about 8 degrees. Alternatively speaking, the bulge radius 1350 and the roll radius 1352 may be tilted in a direction of high toe to low heel by an angle that is greater than about 1 degree and less than about 16 degrees, more preferably greater than about 1 degree and less than about 12 degrees, and most preferably greater than about 1 degree and less than about 8 degrees. It should be noted that although the current tilt angle Φ may generally match the tilt angle θ of the golf club head 1300, the tilt angle Φ of the bulge and roll radius, 1350 and 1352 respectively, can be determined independent of the tilt angle θ of the golf club head 1300 itself without departing from the scope and content of the present invention.

Other than in the operating example, or unless otherwise expressly specified, all of the numerical ranges, amounts, values and percentages such as those for amounts of materials, moment of inertias, center of gravity locations, loft, drposterior angles, various performance ratios, and others in the foregoing portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desirable properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face with a frontal surface area of greater than about 3600 $mm^2$;

a posterior body portion further comprising a crown portion and a sole portion, wherein said crown portion is coupled to an upper portion of said striking face and said sole portion is coupled to a lower portion of said striking face;

wherein said striking face has a variable thickness, wherein said striking face has an elliptical geometry with an elliptical factor of greater than about 0.5, and wherein said elliptical factor is defined as a length of a minor axis of said striking face divided by a length of a major axis of said striking face.

2. The golf club head of claim 1, wherein said variable thickness further comprises;

a thick central portion;

a transition portion; and a thin perimeter portion;

wherein said transition portion surrounds said thick central portion, wherein said thin perimeter portion surrounds said transition portion, and wherein a placement of a geometric center of said thick central portion within said transition portion is offset from a geometric center of said thin perimeter portion.

3. The golf club of claim 2, wherein said placement of said thick central portion within said perimeter portion is biased toward the sole of said golf club head.

4. The golf club head of claim 3, wherein a transition width at a top of said transition portion is greater than a transition width at a bottom of said transition portion.

5. The golf club head of claim 4, wherein said transition width of said bottom of said transition portion is less than about 80% of said transition width of said top of said transition portion.

6. The golf club head of claim 2, wherein said placement of said thick central portion within said thin perimeter portion is biased toward the crown of said golf club head.

7. The golf club head of claim 2, wherein said placement of said thick central portion within said thin perimeter portion is biased toward a heel of said golf club head.

8. The golf club head of claim 2, wherein said placement of said thick central portion within said thin perimeter portion is biased toward a toe of said golf club head.

9. A golf club head comprising:

a striking face with a frontal surface area of greater than about 3600 $mm^2$; and a posterior body portion further comprising a crown portion and a sole portion, wherein said crown portion is coupled to an upper portion of said striking face and said sole portion is coupled to a lower portion of said striking face; and said striking face has a variable face thickness further comprising;

a thick central portion;

a transition portion; and a thin perimeter portion, wherein said transition portion surrounds said thick central portion, wherein said thin perimeter portion surrounds said transition portion, and wherein a placement of a geometric center of said thick central portion within said transition portion is offset from a geometric center of said thin perimeter portion.

10. The golf club head of claim 9, wherein said placement of said thick central portion within said perimeter portion is biased toward the sole of said golf club head.

11. The golf club head of claim 9, wherein said placement of said thick central portion within said thin perimeter portion is biased toward the crown of said golf club head.

12. The golf club head of claim 9, wherein said placement of said thick central portion within said thin perimeter portion is biased toward a heel of said golf club head.

13. The golf club head of claim 9, wherein said placement of said thick central portion within said thin perimeter portion is biased toward a toe of said golf club head.

14. The golf club head of claim 9, wherein said frontal surface area of said striking face comprises of at least 9 percent of a total surface area of said golf club head.

15. The golf club head of claim 14, wherein said total surface area of said golf club head is between about 32,000 $mm^2$ and about 35000 $mm^2$.

16. The golf club head of claim 14, wherein said frontal surface area is greater than about 3750 $mm^2$.

* * * * *